US009662536B1

(12) United States Patent
Lin

(10) Patent No.: US 9,662,536 B1
(45) Date of Patent: May 30, 2017

(54) SQUAT RACK

(71) Applicant: ASIA REGENT CORPORATION, Taichung (TW)

(72) Inventor: Yi-Hung Lin, Taichung (TW)

(73) Assignee: ASIA REGENT CORPORATION, Taichung (TW)

( * ) Notice: Subject to any disclaimer, the term of this patent is extended or adjusted under 35 U.S.C. 154(b) by 0 days.

(21) Appl. No.: 15/093,624

(22) Filed: Apr. 7, 2016

(51) Int. Cl.

| | |
|---|---|
| ***A63B 21/02*** | (2006.01) |
| ***A63B 23/04*** | (2006.01) |
| ***A63B 21/04*** | (2006.01) |
| ***A63B 21/00*** | (2006.01) |
| ***A63B 23/035*** | (2006.01) |

(52) U.S. Cl.
CPC ..... *A63B 23/0405* (2013.01); *A63B 21/0414* (2013.01); *A63B 21/151* (2013.01); *A63B 21/4031* (2015.10); *A63B 21/4034* (2015.10); *A63B 21/4035* (2015.10); *A63B 23/03516* (2013.01); *A63B 23/03525* (2013.01); *A63B 2023/0411* (2013.01)

(58) Field of Classification Search
USPC ..... 482/1–148
See application file for complete search history.

(56) References Cited

U.S. PATENT DOCUMENTS 5,100,131 A * 3/1992 Fong ..... A61H 1/0292 482/112
5,338,277 A * 8/1994 Yang ..... A63B 23/0233 482/130
5,833,590 A * 11/1998 Chiu ..... A63B 21/0552 482/112
5,931,769 A * 8/1999 Nunez ..... A61H 1/0292 482/121
6,022,303 A * 2/2000 Abdo ..... A63B 23/0211 482/121
6,135,930 A * 10/2000 Kuo ..... A63B 22/001 482/57
6,248,047 B1 * 6/2001 Abdo ..... A63B 21/023 482/121
6,544,151 B2 * 4/2003 Tornabene ..... A63B 21/055 482/122
6,602,171 B1 * 8/2003 Tsen ..... A63B 21/023 482/140
6,752,748 B1 * 6/2004 Scotti ..... A63B 21/0615 482/140
7,125,366 B1 * 10/2006 Yeh ..... A63B 21/055 482/122

(Continued)

*Primary Examiner* — Stephen Crow

(57) ABSTRACT

A squat rack includes a frame, a lifting unit, a body support unit, an elastic unit and a tread unit. The frame includes a horizontal portion, a vertical portion connected to the horizontal portion, and a handle connected to the vertical portion. The lifting unit is pivotally connected to the frame. The body support unit is connected to an upper portion of the lifting unit. The elastic unit is provided between the frame and the lifting unit and adapted for raising the lifting unit from the frame. The tread unit is connected to the horizontal portion of the frame, between the handle and the body support unit in a horizontal direction. While exercising, a user can set his or her feet on the tread unit, hold the handle with his or her hands, and lean on the lifting unit to gain support from the elastic unit.

20 Claims, 7 Drawing Sheets

(56) References Cited

U.S. PATENT DOCUMENTS

| | | | | |
|---|---|---|---|---|
| 7,229,389 | B2 * | 6/2007 | Hong | A63B 21/0552 482/142 |
| 7,326,159 | B2 * | 2/2008 | Rong | A63B 21/0004 482/140 |
| 7,329,213 | B1 * | 2/2008 | Farley | A63B 23/0211 482/140 |
| 7,563,211 | B1 * | 7/2009 | Wu | A63B 21/045 482/123 |
| 7,811,215 | B2 * | 10/2010 | Wallach | A63B 21/0552 482/121 |
| 8,556,780 | B2 * | 10/2013 | Chen | A63B 21/023 482/140 |
| 8,641,588 | B2 * | 2/2014 | Verheem | A63B 21/0421 482/140 |
| 9,480,340 | B1 * | 11/2016 | Harlow | A47C 7/543 |
| 2004/0053757 | A1 * | 3/2004 | Chung | A63B 23/03525 482/140 |
| 2005/0075224 | A1 * | 4/2005 | Lin | A63B 21/0004 482/130 |
| 2005/0075225 | A1 * | 4/2005 | Shin | A63B 21/0004 482/130 |
| 2005/0181916 | A1 * | 8/2005 | Frost | A63B 21/0004 482/140 |

* cited by examiner

SQUAT RACK

BACKGROUND OF INVENTION

1. Field of Invention

The present invention relates to an exercise machine and, more particularly, to a squat rack.

2. Related Prior Art

To squat, a person has to use his or her upper legs, abdomen and lower back. Hence, a person can squat to exercise muscles in his or her torso, waist, abdomen, hips and upper legs. However, a person can exert too much stress in his or her knees or upper legs and hence excessively wear the knees or pull the muscles in the upper legs.

Taiwanese Patent Publication No. 313866 discloses a conventional squat rack for helping a user squat. The conventional squat rack includes a lower tube 1 connected to a upper tube 2, a seat tube 10 pivotally connected to the upper tube 2, a leg tube 20 pivotally connected to the upper tube 2, a handle 30 pivotally connected to the upper tube 2, a connector 4 for connecting the seat tube 10 to the leg tube 20, and a connector 40 for connecting the seat tube 10 to the handle 30. Thus, the leg tube 20 is pivoted together with the handle 30. Hence, the user's hands, torso and legs move together with the conventional squat rack. Hence, the user's muscles in the waist and upper legs are only subject to light loads. That is, the user does not exercise the waist and upper legs sufficiently. The conventional squat rack is not effective in helping the user to exercise the waist and upper legs.

The present invention is therefore intended to obviate or at least alleviate the problems encountered in prior art.

SUMMARY OF INVENTION

It is an objective of the present invention to provide a squat rack to help a user correctly exercise his or her muscles while squatting.

It is another objective of the present invention to provide a squat rack for intensifying a user's exercise by providing resistance while the user is squatting.

To achieve the foregoing objectives, the squat rack includes a frame, a lifting unit, a body support unit, an elastic unit and a tread unit. The frame includes a horizontal portion, a vertical portion connected to the horizontal portion, and a handle connected to the vertical portion. The lifting unit is pivotally connected to the frame. The body support unit is connected to an upper portion of the lifting unit. The elastic unit is provided between the frame and the lifting unit and adapted for raising the lifting unit from the frame. The tread unit is connected to the horizontal portion of the frame, between the handle and the body support unit in a horizontal direction. While exercising, a user can set his or her feet on the tread unit, hold the handle with his or her hands, and lean on the lifting unit to gain support from the elastic unit.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
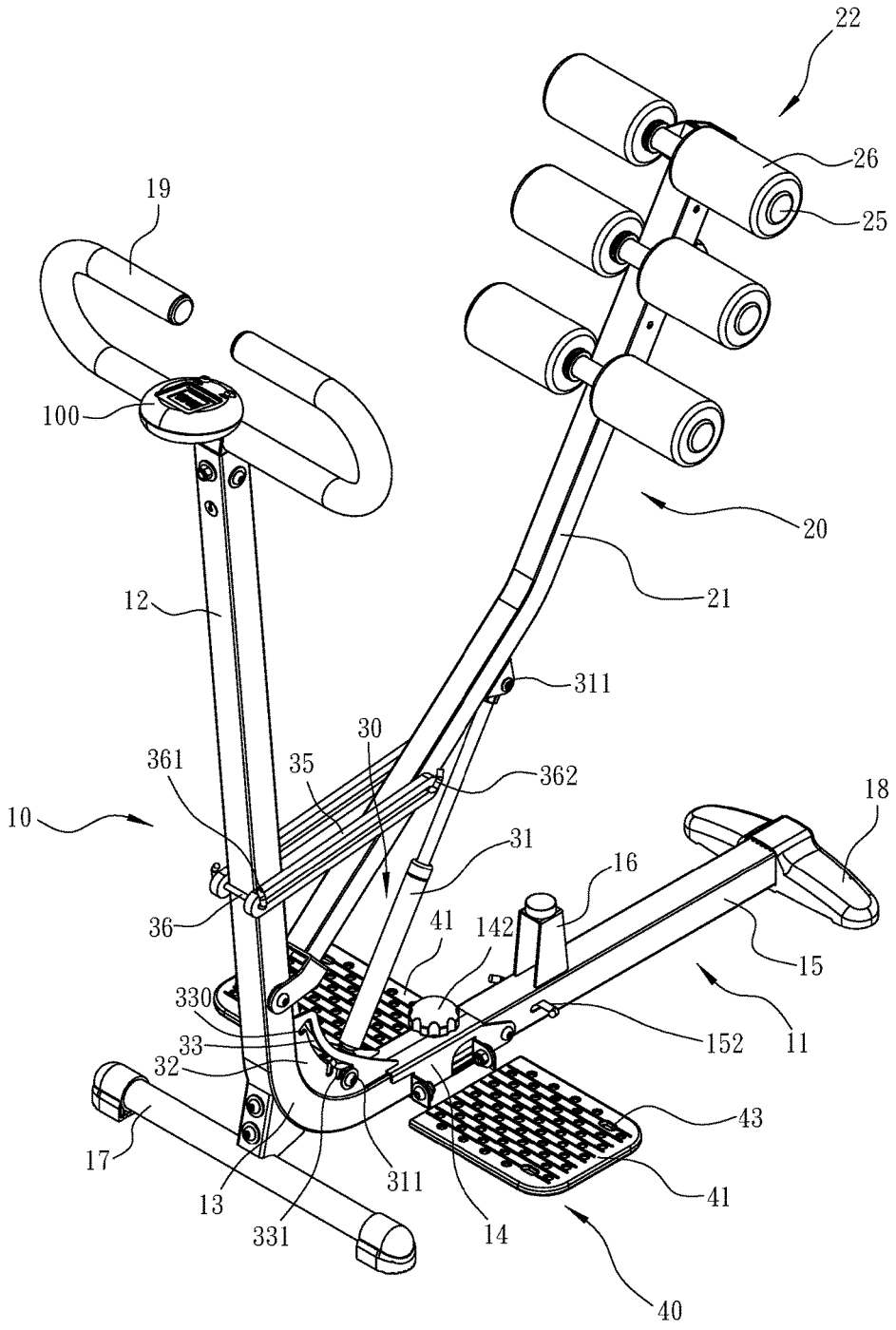
FIG. 1 is a perspective view of a squat rack according to the preferred embodiment of the present invention.

Referring to FIG. 1, a squat rack includes a frame (10), a lifting unit (20) pivotally connected to the frame (10), an elastic unit (30) for biasing the lifting unit (20) upwards relative to the frame (10), and a tread unit (40) connected to the frame (10) according to the preferred embodiment of the present invention.

Figure 2:
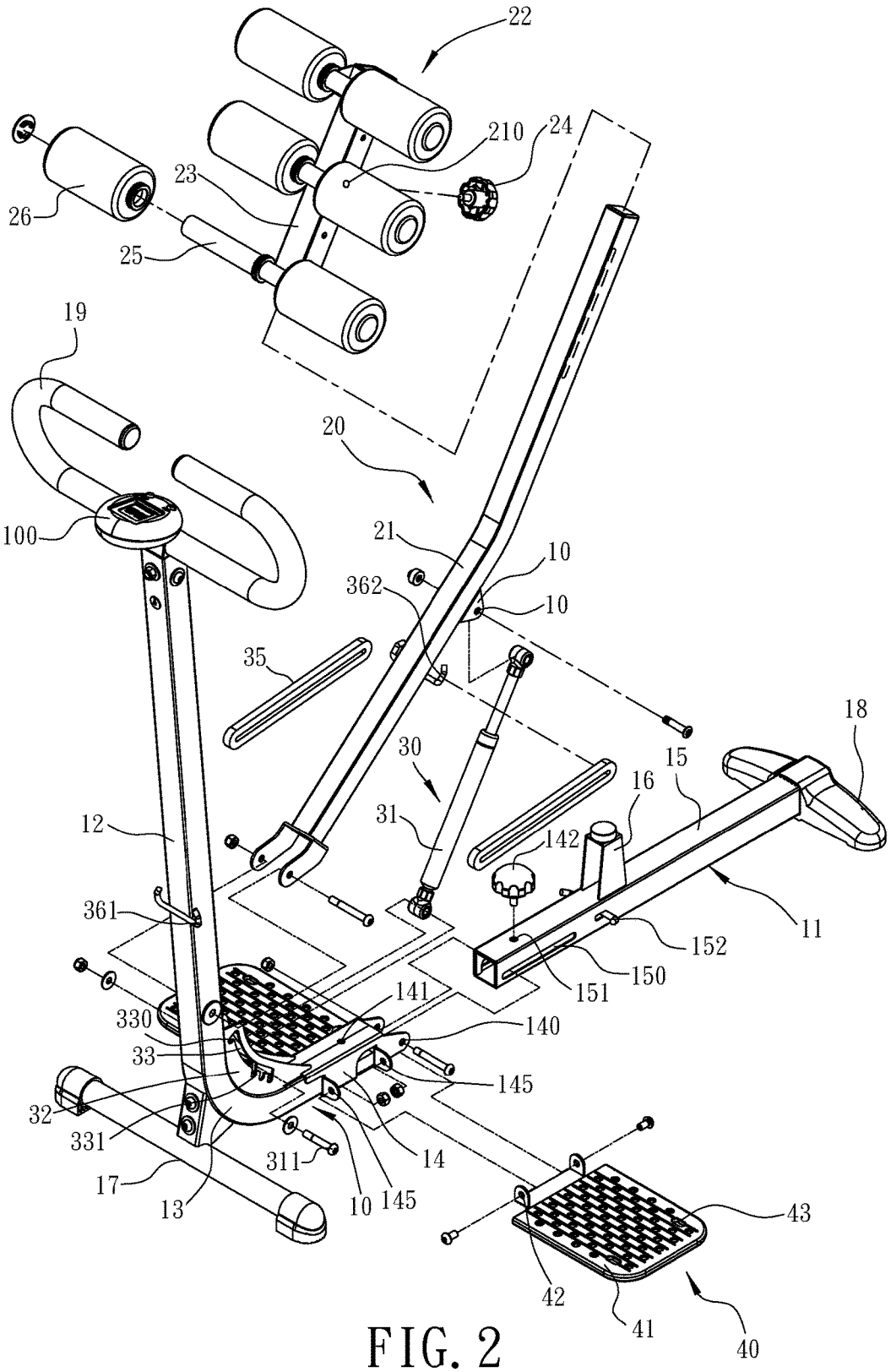
FIG. 2 is an exploded view of the squat rack shown in FIG. 1.
Figure 3:
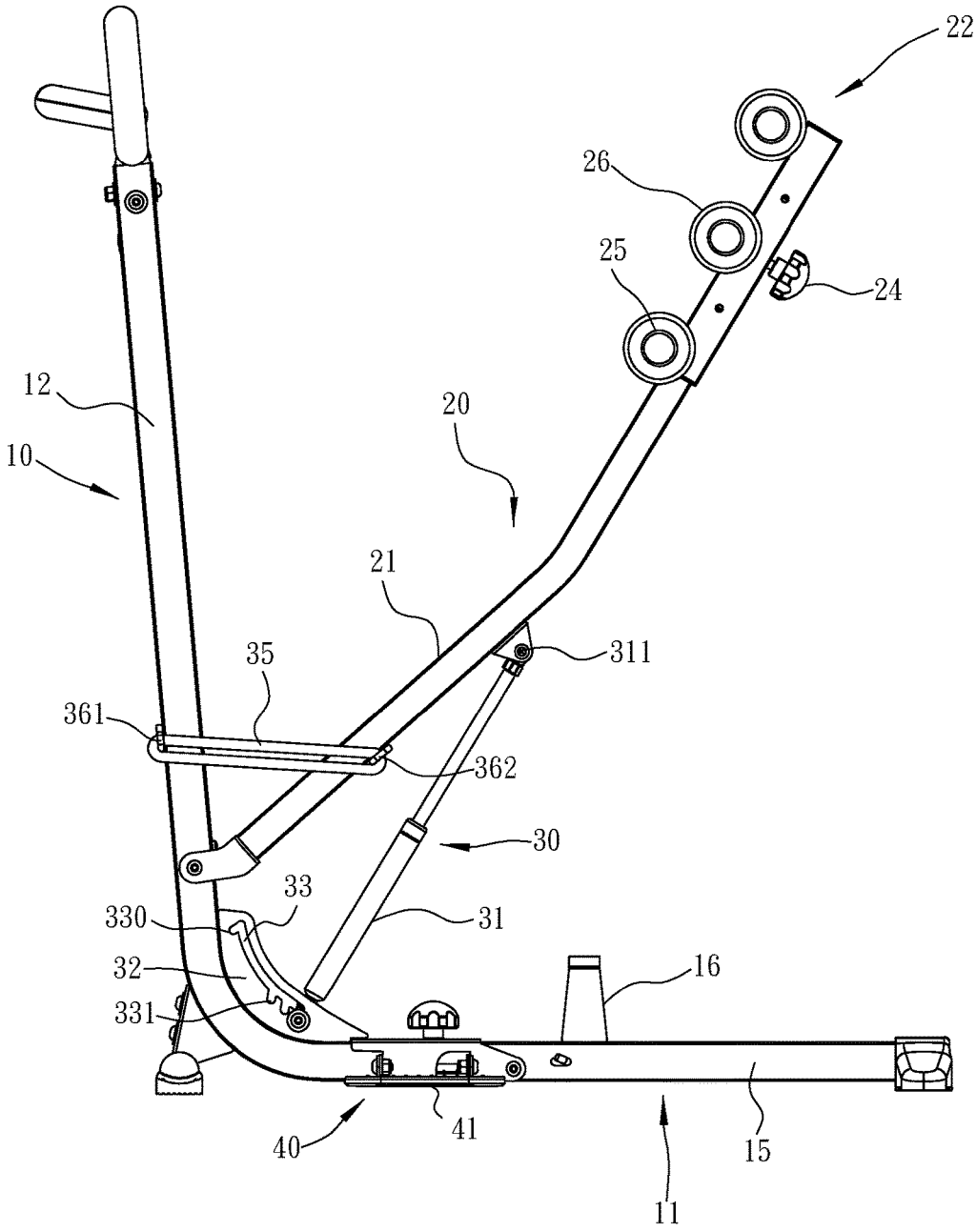
FIG. 3 is a side view of the squat rack shown in FIG. 1.

Referring to FIGS. 1 through 3, the frame (10) includes a horizontal portion (11), a vertical portion (12), a bent portion (13), a stationary sleeve (14), a front transverse element (17) and a rear transverse element (18). The vertical portion (12) and the bent portion (13) are made in one piece, i.e., a metallic tube. The stationary sleeve (14) is connected to the bent portion (13). The horizontal portion (11) is pivotally connected to the stationary sleeve (14).

A handle 19 is connected to an upper end of the vertical portion (12). Thus, a user can use the handle (19) to balance and support his or her body while exercising with the squat rack.

An instrument (100) is also attached to the upper end of the vertical portion (12). The user can observe the instrument (100) to monitor the status of his or her exercise.

The horizontal portion (11) includes a tube (15) and a supporting element (16). The tube (15) includes two slots (150) in two lateral sides, an aperture (151) in an upper face, and two hooks (152) on the lateral sides. In another embodiment, the tube (15) can be replaced with a solid rod that includes a slot instead of two slots (150). The supporting element (16) is provided on the upper face of the tube (15). The supporting element (16) is adapted for supporting the lifting unit (20) when the lifting unit (20) is lowered.

The stationary sleeve (14) is connected to a free end of the bent portion (13). The stationary sleeve (14) is used to receive the horizontal portion (11). A limiting element (140) is transversely inserted throughout the stationary sleeve (14). The stationary sleeve (14) includes a screw hole (141) in an upper face and two lugs (145) on each lateral side.

The tube (15) is inserted in the stationary sleeve (14). A limiting element (140) is inserted in the stationary sleeve (14) and the slots (150) to movably connect the tube (15) to the stationary sleeve (14). The tube (15) can be translated and pivoted relative to the stationary sleeve (14). The limiting element (140) can be a threaded bolt, a pin, a rivet or any other proper element. A fastener (142) can be inserted in the aperture (151) via the screw hole (141) to retain the tube (15) in position relative to the stationary sleeve (14).

The front transverse element (17) is attached to the bent portion (13). The transverse element (18) is connected to a rear end of the tube (15). The front transverse element (17) and the rear transverse element (18) are used to firmly support the frame (10) and hence the entire squat rack on a floor or the ground.

Figure 7:
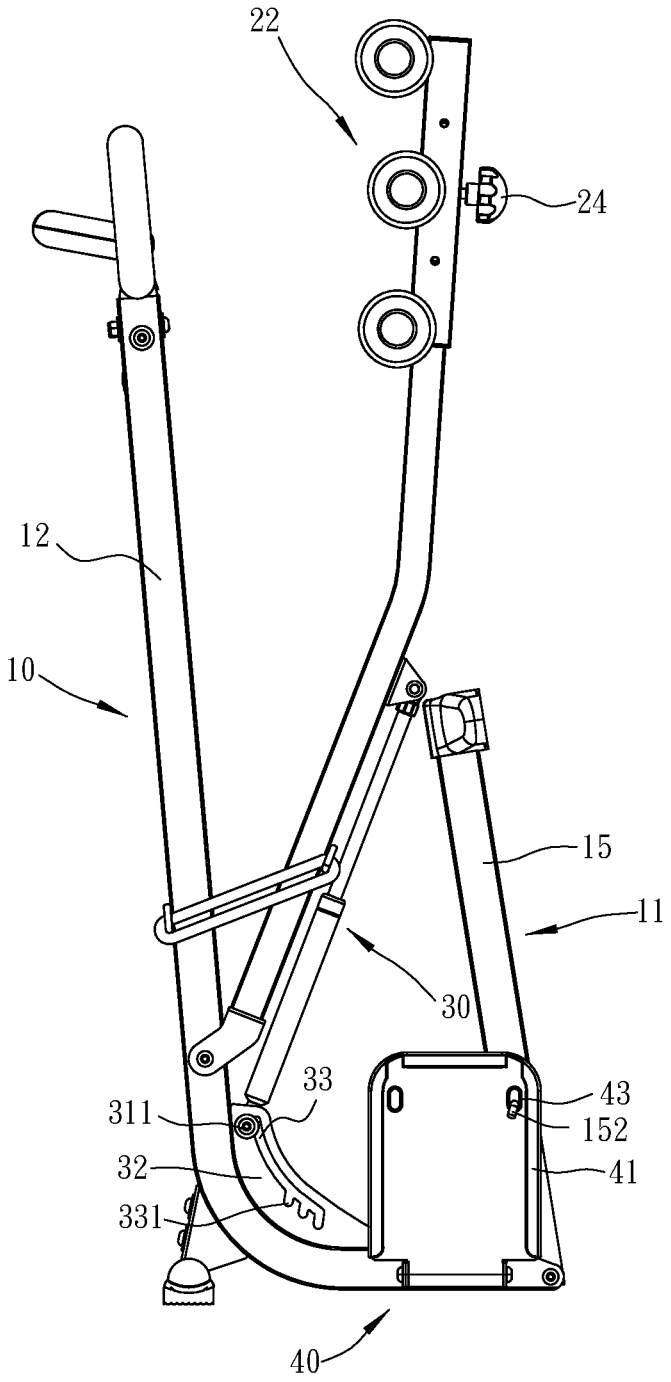
FIG. 7 is a side view of the squat rack in another position than illustrated in FIG. 3.

The tread unit (40) includes two treads (41). Each of the treads (41) includes two lugs (42) at an edge and apertures (43). The lugs (42) of each of the treads (41) are pivotally connected to the lugs (145) on a corresponding lateral side of the stationary sleeve (14). Thus, the treads (41) are pivotally connected to the stationary sleeve (14). Referring to FIG. 7, the treads (14) can be pivoted upwards and then held position by the hooks (152).

The lifting unit (20) is pivotally connected to the frame (10). The lifting unit (20) includes a lever (21) and a body support unit (22). A front, lower end of the lever (21) is pivotally connected to the vertical portion (12), near the bent portion (13). The lever (21) includes adjusting bores (210) near a rear, upper end.

The body support unit (22) is attached to the rear, upper end of the lever (21). The body support unit (22) includes a movable sleeve (23), a fastener (24), axles (25) and tubular pads (26). The movable sleeve (23) is movably supported on the rear, upper end of the lever (21). The fastener (24) can be inserted in a selected one of the adjusting bores (210) through the movable sleeve (23) to keep the movable sleeve (23) in a selected one of various positions on the lever (21). The axles (25) are attached to the movable sleeve (23) by welding for example. The tubular pads (26) are rotationally supported on the axles (25). While exercising with the squat rack, the user can lean on the tubular pads (26) and roll the tubular pads (26). The rolling of the tubular pads (26) is useful in reducing undesired resistance against the user's exercise with the squat rack.

The elastic unit (30) is provided between the frame (10) and the lifting unit (20). The elastic unit (30) includes an elastic telescopic element (31), two positioning plates (32) and two rubber bands (35). The elastic unit (30) is a hydraulic or pneumatic cylinder.

The positioning plates (32) are attached to the bent portion (13) of the frame (10). Each of the positioning plates (32) includes an arched slot (33), a retaining recess (330) in communication with a front, upper portion of the arched slot (33), and adjusting recesses (331) in communication with a rear, lower portion of the arched slot (33).

A first pivot (311) is used to pivotally connect an upper end of the elastic telescopic element (31) to two lugs (211) attached to the lever (21) by welding for example. A second pivot (311) is used to pivotally connect a lower end of the elastic telescopic element (31) to the positioning plates (32). To this end, the pivot (311) is inserted in the arched slots (33) of the positioning plates (32) and the lower end of elastic telescopic element (31). The pivot (311) is movable in and along the arched slots (33) so that the angle of the elastic telescopic element (31) and that of the lifting unit (20) can be changed. The pivot (311) includes two portions each for insertion in a selected one of the adjusting recesses (331) in each of the positioning plates (32) to keep the elastic telescopic element (31) and the lifting unit (20) in a selected one of various positions relative to the positioning plates (32) and hence the frame (10). Thus, the support provided for the lifting unit (20) by the elastic telescopic element (31) is adjustable. Referring to FIG. 7, the pivot (311) can be inserted in the retaining recesses (330) to facilitate the squat rack to be collapsed. In the collapsed position, the lifting unit (20) is located close to the vertical portion (12) of the frame (10) while the elastic telescopic element (31) is located close to the lifting unit (20).

Two hooks (361) are attached to the vertical portion (12) of the frame (10) by welding for example. Two hooks (362) are attached to the lever (21) by welding for example. Each of the rubber bands (35) includes an end hooked by a corresponding one of the hooks (361) and another end hooked by a corresponding one of the hooks (362). The rubber bands (35) tend to raise the lifting unit (20) relative to the frame (10).

Figure 4:
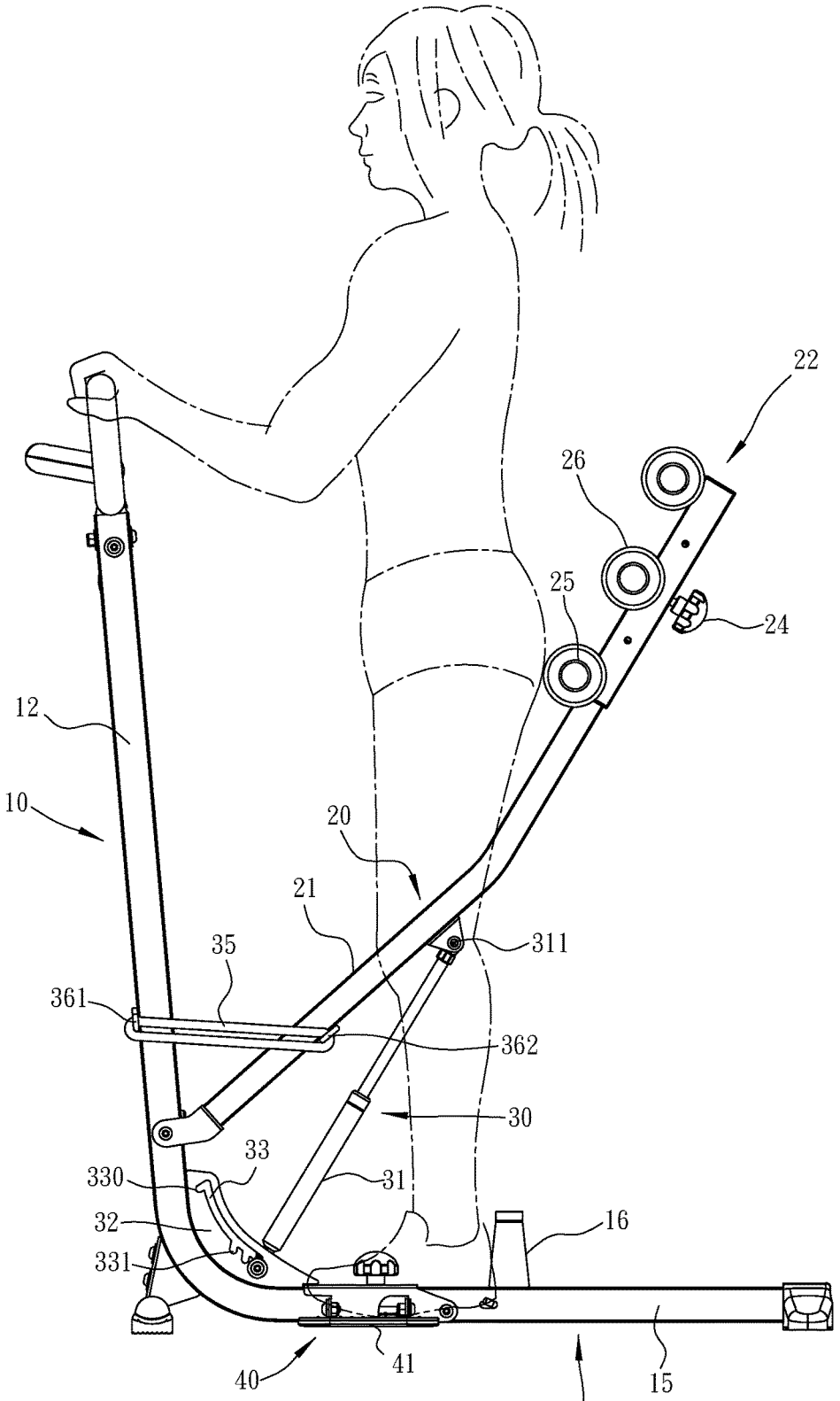
FIG. 4 is a side view of a user using the squat rack shown in FIG. 1.
Figure 5:
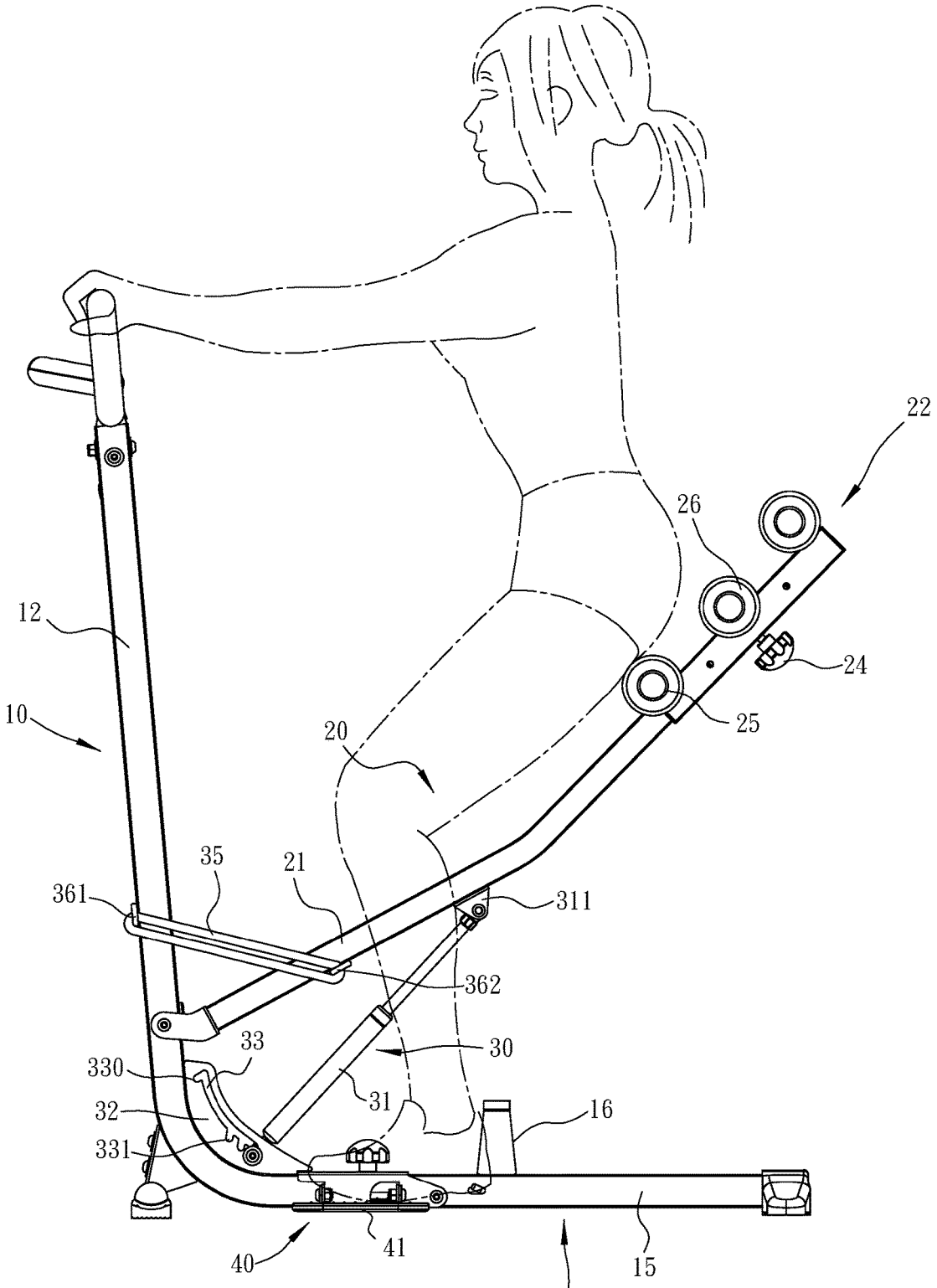
FIG. 5 is a side view of a user and the squat rack in another position than shown in FIG. 4.

Referring to FIGS. 4 and 5, the user uses the squat rack to exercise. The user spreads her legs on two sides of the lever (21), sets her feet on the treads (41), and holds the handle (19) with her hands. The elastic unit (30) tends to cause the lifting unit (20) to pivot upwards relative to the frame (10). Hence, the body support unit (22) of the lifting unit (20) is pressed against the user's hips.

Figure 6:
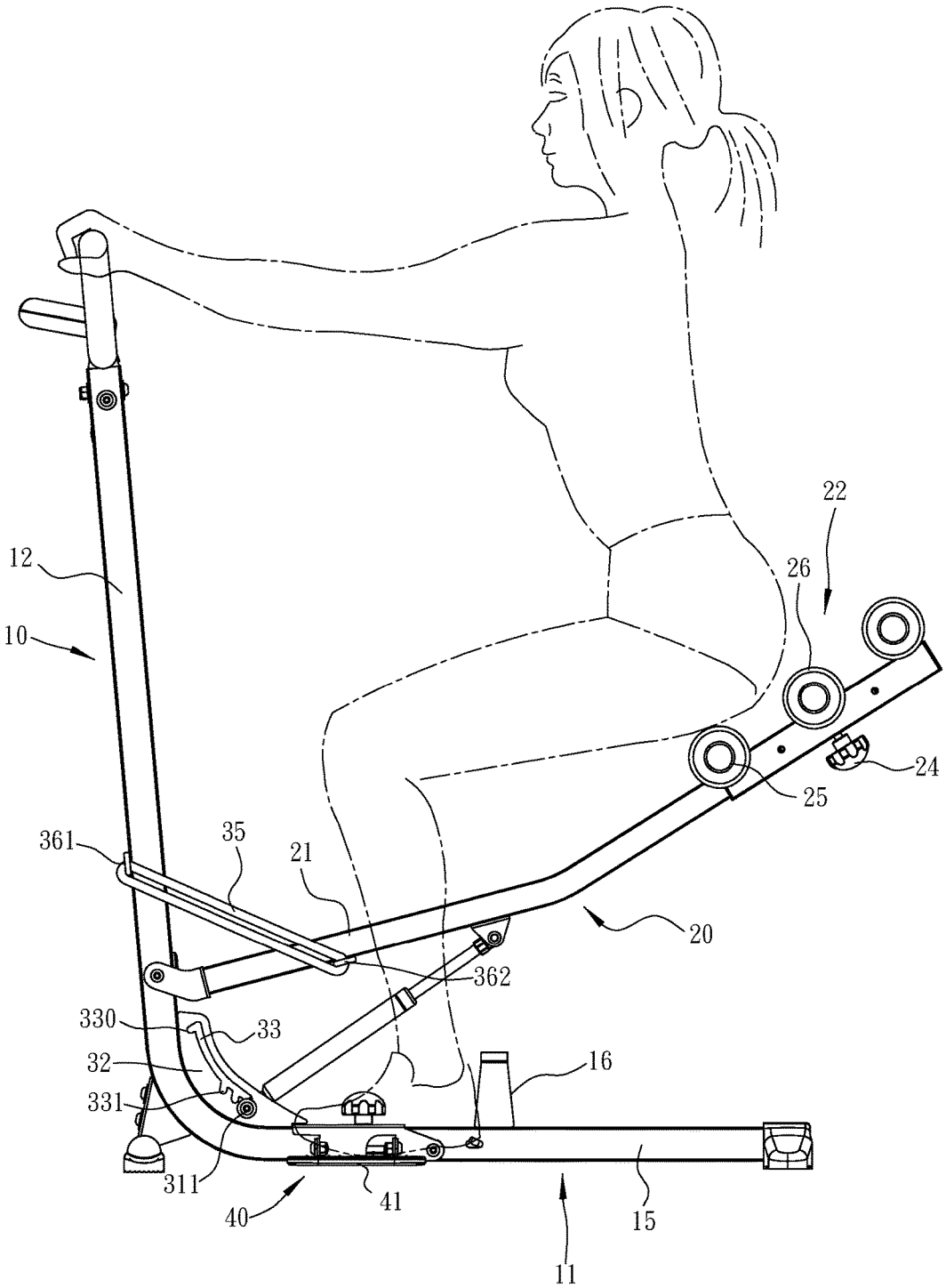
FIG. 6 is a side view of a user and the squat rack in another position than shown in FIG. 5.

Referring to FIGS. 5 and 6, the user squats, i.e., bends her knees and lowers her hips, with her hands holding the handle (19) to balance her body. While squatting, the user gains support from the lifting unit (20), which is in turn biased by the elastic unit (30), which is arranged between the lifting unit (20) and the frame (10). Thus, the user does not have to carry all her weight on her knees and legs with the help from the squat rack while squatting. That is, the user does not impose an excessive load on her knees and legs while squatting.

Then, the user stands up. On her way up, the elastic unit (30) causes the lifting unit (20) to lift the user. That is, the elastic unit (30) causes the lifting unit (20) to help the user stand up. Similarly, the user does not have to carry all her weight on her knees and legs with the help from the squat rack while standing up. That is, the user does not impose an excessive load on her knees and legs while standing up.

Referring to FIG. 7, the squat rack is collapsed to reduce the space it occupies for convenience in storage and transportation. To this end, the second pivot (311), which is connected to the elastic telescopic element (31), is removed from the positioning recesses (331), moved in and along the arched slot (33), and inserted in the retaining recesses (330). Then, the fastener (142) of the frame (10) is operated to release the tube (15), i.e., to allow the tube (15) to translate and pivot relative to the stationary sleeve (14). Then, the tube (15) is translated from the stationary sleeve (14) until a closed end of each of the slots (150) reaches the limiting element (140). Then, the tube (15) is pivoted upwards about the limiting element (140). The treads (41) are pivoted upwards. The hooks (152) are inserted in the apertures (43) and hook the treads (41) to keep the treads (41) close to the tube (15).

Advantageously, the squat rack involves an ergonomic design to keep the center of the user's weight and the center of weight of the squat rack in a same vertical line because the tread unit (40) is located between the handle (19) and the body support unit (22) in a horizontal direction. Hence, while squatting and standing up, the user's weight helps keep the squat rack firmly on the floor. With the squat rack firmly kept on the floor, the user's safety is ensured, and the user gains proper support and hence correctly uses her muscles while exercising.

Advantageously, the user does not have to carry all her weight on her knees and legs with the help from the squat rack while squatting or standing up. That is, the user does not impose an excessive load on her knees and legs while squatting or standing up. Hence, the user can exercise for a long period of time without hurting herself.

Advantageously, the tubular pads (26) are rolled by the user while the user is leaning on the tubular pads (26) in exercise. Thus, undesired resistance against the user's exercise is reduced. Hence, the exercise of the user and the operation of the squat rack are smooth.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A squat rack comprising:

a frame comprising a horizontal portion, a vertical portion connected to the horizontal portion, and a handle connected to the vertical portion;

a lifting unit pivotally connected to the vertical portion of the frame;

a body support unit connected to an upper portion of the lifting unit;

an elastic unit provided between the frame and the lifting unit and adapted for raising the lifting unit from the frame; and a tread unit connected to the horizontal portion of the frame, between the handle and the body support unit in a horizontal direction, wherein a user can stand on the tread unit, hold the handle with his or her hands, and lean on the lifting unit to gain support from the elastic unit while exercising.

2. The squat rack according to claim 1, wherein the frame further comprises:

a bent portion formed between the horizontal portion and the vertical portion; and a stationary sleeve connected to an end of the bent portion near the horizontal portion, wherein the horizontal portion is movably connected to the stationary sleeve.

3. The squat rack according to claim 2, wherein the horizontal portion of the frame comprises a tube movably connected to the stationary sleeve.

4. The squat rack according to claim 3, wherein the frame further comprises a front transverse element connected to the bent portion and a rear transverse element connected to the tube, wherein the front and rear transverse elements keep the frame firmly on a floor.

5. The squat rack according to claim 2, wherein the tread unit comprises two treads each pivotally connected to a lateral side of the stationary sleeve.

6. The squat rack according to claim 5, wherein the stationary sleeve comprises two lugs each pivotally connected to a corresponding one of the treads.

7. The squat rack according to claim 5, wherein the tube comprises two hooks for hooking the treads to keep the treads pivoted up.

8. The squat rack according to claim 1, wherein the lifting unit further comprises a lever pivotally connected to the vertical portion of the frame, wherein the body support unit is connected to an upper portion of the lever.

9. The squat rack according to claim 8, wherein the body support unit further comprises a movable sleeve movably supported on the lever and a fastener operable for keeping the movable sleeve in position on the lever.

10. The squat rack according to claim 9, wherein the lever comprises adjusting bores, wherein the fastener is inserted in a selected one of the adjusting bores to keep the movable sleeve in a selected one of various positions on the lever.

11. The squat rack according to claim 9, wherein the body support unit further comprises axles connected to the movable sleeve and tubular pads supported on the axles.

12. The squat rack according to claim 1, wherein the elastic unit comprises an elastic telescopic element with an end pivotally connected to the lifting unit and another end pivotally connected to the horizontal portion of the frame.

13. The squat rack according to claim 12, wherein the lifting unit comprises at least one lug formed thereon, wherein the frame further comprises at least one positioning plate formed thereon, wherein the elastic unit further comprises a pivot for connecting an end of the elastic telescopic element to the lug and a second pivot for connecting an opposite end of the elastic telescopic element to the positioning plate.

14. The squat rack according to claim 13, wherein the positioning plate comprises an arched slot, a retaining recess in communication with the arched slot, and adjusting recesses in communication with the arched slot, wherein the second pivot can be moved in and along the arched slot and inserted in a selected one of the recesses to keep the elastic telescopic element in a selected one of various positions relative to the positioning plate.

15. The squat rack according to claim 1, wherein the elastic unit comprises at least one rubber band with an end connected to the lifting unit and an opposite end connected to the vertical portion of the frame.

16. The squat rack according to claim 15, wherein the lifting unit comprises at least one hook for hooking the rubber band.

17. The squat rack according to claim 15, wherein the vertical portion of the frame comprises at least one hook for hooking the rubber band.

18. The squat rack according to claim 1, wherein the tread unit comprises two treads each pivotally connected to a lateral side of the horizontal portion of the frame.

19. The squat rack according to claim 18, wherein the frame further comprises two lugs each pivotally connected to a corresponding one of the treads.

20. The squat rack according to claim 19, wherein the frame further comprises two hooks for hooking the treads to keep the treads pivoted up.

* * * * *